US005234317A

United States Patent [19]

Kajiwara et al.

[11] Patent Number: 5,234,317

[45] Date of Patent: Aug. 10, 1993

[54] SHEET METAL INTERSTAGE CASING FOR A PUMP

[75] Inventors: Ken-ichi Kajiwara; Sou Kuroiwa; Kikuichi Mori; Hideo Ikeda, all of Tokyo, Japan

[73] Assignee: Ebara Corporation, Tokyo, Japan

[21] Appl. No.: 811,067

[22] Filed: Dec. 20, 1991

[30] Foreign Application Priority Data

Dec. 25, 1990 [JP] Japan ..... 2-405838

[51] Int. Cl.[5] ..... F04D 29/60

[52] U.S. Cl. ..... 415/214.1; 415/200

[58] Field of Search ..... 415/214.1, 200, 198.1, 415/199.1, 199.2, 199.3, 182.1

[56] References Cited

U.S. PATENT DOCUMENTS

| | | | |
|---|---|---|---|
| 4,549,849 | 10/1945 | Jensen et al. | 415/182.1 |
| 4,877,372 | 10/1989 | Jensen | 415/214.1 |
| 4,923,367 | 5/1990 | Zimmer | 415/214.1 |

FOREIGN PATENT DOCUMENTS

| | | | |
|---|---|---|---|
| 557444 | 5/1958 | Canada | 415/199.3 |
| 0055426 | 7/1982 | European Pat. Off. . | |
| 3729673 | 3/1989 | Fed. Rep. of Germany | 415/199.1 |
| 3816280 | 11/1989 | Fed. Rep. of Germany . | |
| 917844 | 1/1947 | France | 415/199.3 |
| 91395 | 6/1982 | Japan | 415/198.1 |
| 291495 | 12/1987 | Japan | 415/199.3 |
| 63-170593 | 7/1988 | Japan . | |

OTHER PUBLICATIONS

European Pat. 267,445 May 1988.

*Primary Examiner*—John T. Kwon

*Attorney, Agent, or Firm*—Wenderoth, Lind & Ponack

[57] ABSTRACT

A multistage centrifugal pump has a plurality of series-connected interstage casings of pressed sheet steel housing respective impellers. Each of the interstage casings includes a central cylindrical side wall, a casing end wall, a first cylindrical wall integrally extending from an end of the central cylindrical side wall and joined to the casing end wall, the first cylindrical wall serving as a male member of a spigot joint, and a second cylindrical wall integrally extending from an opposite end of the central cylindrical side wall and having a flange defining an end opening therein, the second cylindrical wall serving as a female member of a spigot joint. The central cylindrical side wall has an outside diameter larger than outside diameters of the first cylindrical wall and the flange. The interstage casing is formed by drawing and bulging, and is not machined to achieve the desired dimensional accuracy. Therefore, the interstage casing is free from deformations and dimensional errors which would otherwise tend to occur under forces that would be developed if the blank were fastened for machining, and stresses and heat that would be developed if the blank were machined.

11 Claims, 4 Drawing Sheets

SHEET METAL INTERSTAGE CASING FOR A PUMP

BACKGROUND OF THE INVENTION

The present invention relates to an interstage casing for a pump made of sheet metal, and more particularly to an interstage casing for a pump made of sheet metal and pressed into shape for use in a multistage centrifugal pump.

Conventionally, there is known an interstage casing for a pump in which a casing is formed of sheet metal such as a stainless steel plate and manufactured by press working the sheet metal.

This type of interstage casing is shown in FIG. 5 of the accompanying drawings. FIG. 5 shows the interstage casing housing return blades therein. The interstage casing shown in FIG. 5 is constructed as follows. As shown in FIG. 6 (*a*) of the accompanying drawings, a metal sheet such as a stainless steel plate is pressed into a cylindrical receptacle-like structure comprising a cylindrical side wall 1 and a bottom wall (or casing end wall) 2 on an outlet end thereof. Then, as shown in FIG. 6 (*b*), an open inlet end 3 of the cylindrical side wall 1 is bent radially inwardly. Thereafter, as shown in FIG. 5, a return blade 4 and other parts are welded to the inner surface of the bottom wall 2. Then, the outer peripheral surface of the bottom wall 2 is machined to form a radially outer surface 2*a* and a radial end surface 2*b* which lie perpendicularly to each other, providing the male member of a spigot joint for fitting engagement with the open inlet end of a subsequent interstage casing which houses an impeller for developing a higher head. The open inlet end 3 is also machined to form a radially inner surface 3*a* and a radial end surface 3*b* which lie perpendicularly to each other, providing the female member of a spigot joint for fitting engagement with the outer peripheral surface of the bottom wall of a preceding interstage casing which houses an impeller for developing a lower head. Incidentally, finish marks are used to represent machined portions.

The interstage casing of the above structure houses an impeller 5 that can be rotated by a shaft 6. A liner ring 7 is attached to the bottom wall 2.

FIG. 7 of the accompanying drawings illustrates a multistage centrifugal pump comprising a plurality of series-connected interstage casings 1, each having the structure shown in FIG. 5. As shown in FIG. 7, the interstage casings 1 are assembled together by a fastening band 8. The shaft 6 is rotatably supported by an upper bearing 9*a* and a lower bearing 9*b*. The multistage centrifugal pump includes a discharge casing 10, a suction casing 11, a valve body 12, a strainer 13, and a cable cover 14.

When the multistage centrifugal pump is in operation, the liquid to be pumped is drawn through the strainer 13 and its pressure is increased successively by the impellers 5. The pressure head of the liquid is restored as the liquid passes through each of the return blades 4. Finally, the liquid is discharged out of the pump through a discharge port defined in the discharge casing 10.

The interstage casing of pressed sheet metal shown in FIG. 5 maintains a desired degree of dimensional accuracy for diameters and heights through the machining of the four regions, i.e., the radially outer surface 2*a*, the radial end surface 2*b*, the radially inner surface 3*a*, and the radial end surface 3*b*. However, these surfaces have to be machined with utmost care because the pressed sheet metal is thin enough to be easily deformed by forces that are applied when the sheet metal is fastened for machining, or by stresses and heat that are developed when the steel sheet is machined.

Sealing between the interstage casings is achieved by liquid gaskets that are of relatively low reliability since no installation space is available between the interstage casings for O-rings that are widely used in pump casings made by casting. Consequently, the interstage casings with liquid gaskets are not suitable for use in applications that require the development of very high pressures or environments that should be kept free of liquid leaked from the pump.

SUMMARY OF THE INVENTION

It is an object of the present invention to provide an interstage casing for a pump, made of sheet metal pressed into shape, which is free from machining processes that would otherwise be necessary to produce highly accurate regions, and hence from mechanical failures and dimensional errors that would otherwise possibly result from such machining processes, and which allows general O-rings to be used as seals between the stages of the pump.

To achieve the above object, there is provided in accordance with the present invention an interstage casing of pressed sheet metal for use in a pump, comprising a central cylindrical side wall; a bottom wall (or casing end wall); a first cylindrical wall integrally extending from an end of the central cylindrical side wall and joined to the bottom wall, the first cylindrical wall serving as a male member of a spigot joint; and a second cylindrical wall integrally extending from an opposite end of the central cylindrical side wall and having a flange defining an end opening therein, the second cylindrical wall serving as a female member of a spigot joint; wherein the central cylindrical side wall has an outside diameter larger than outside diameters of the first cylindrical wall and the flange.

The interstage casing further includes a beveled surface between the second cylindrical wall and the flange, the beveled surface providing a space for installing an O-ring therein.

The central cylindrical side wall is fabricated by bulging radially outwardly a drawn blank having a diameter corresponding to the diameter of the male and female members of the spigot joints.

The first cylindrical wall is fitted over the second cylindrical wall of an adjacent interstage casing, and the end surface of the flange of the second cylindrical wall of the adjacent interstage casing is held against a radial end wall extending perpendicularly from the first cylindrical wall. The first and second cylindrical walls, the flange, and the radial end wall are fabricated by a mold with a degree of dimensional accuracy corresponding to that of the mold. Therefore, the interstage casing is not required to be machined to provide the desired dimensional accuracy.

The beveled surface lying between the second cylindrical wall and the flange allows an O-ring to be used as a seal between the interstage casing and an adjacent interstage casing. Since O-rings, which are used most generally as interstage seals in multistage centrifugal pumps, can be employed with the interstage casing, the interstage casing, formed of pressed sheet metal, is applicable to high-pressure pumps which develop high pressures.

The central cylindrical side wall is formed by bulging radially outwardly a drawn blank having a diameter corresponding to the diameter of the male and female members of the spigot joints, under the pressure of a fluid or an elastic medium. Also, the central cylindrical side wall is formed by roll forming under the pressure of rolls. Consequently, the interstage casing can be fabricated in a highly accurate manner with a uniform thickness, and manufactured at an increased rate of production.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

An interstage casing for a pump made of sheet metal according to an embodiment of the present invention will be described with reference to FIG. 1.

Figure 1:
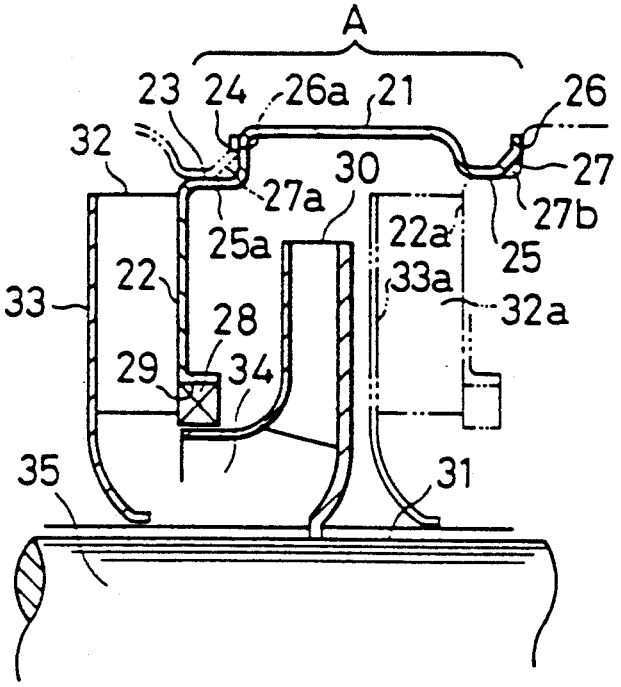
FIG. 1 is a fragmentary cross-sectional view of one half of an interstage casing according to an embodiment of the present invention.

FIG. 1 shows in fragmentary cross section one half of an interstage casing according to an embodiment of the present invention, with a return blade disposed outside the interstage casing. The interstage casing is formed of sheet metal such as stainless steel and used particularly in a multistage centrifugal pump.

As shown in FIG. 1, an interstage casing is in the form of a deformed cylindrical receptacle-like body A comprising a central cylindrical side wall 21, a bottom wall (or casing end wall) 22 to be coupled to a preceding interstage casing (on the left-hand side of FIG. 1) that houses an impeller for developing a lower head, an axial cylindrical wall 23 joined to the bottom wall 22 and smaller in diameter than the central cylindrical side wall 21, and a radial end wall 24 integrally joined to and extending between the cylindrical wall 23 and the central cylindrical side wall 21. The axial cylindrical wall 23 serves as the male member of a spigot joint, the radial end wall 24 extends perpendicularly to a pump shaft 31.

The cylindrical receptacle-like body A also includes, at an open end thereof remote from the bottom wall 22, a cylindrical wall 25 to be coupled to a subsequent interstage casing (on the right-hand side of FIG. 1) that houses an impeller for developing a higher head. The cylindrical wall 25 is integrally joined to the central cylindrical side wall 21 and has an inside diameter such that it fits over the cylindrical wall 23 of the next (or subsequent) interstage casing. Therefore, the cylindrical wall 25 serves as the female member of a spigot joint. To the open end of the cylindrical wall 25, there is joined a cylindrical flange 26 whose outside diameter is smaller than the outside diameter of the central cylindrical side wall 21. The cylindrical wall 25 and the cylindrical flange 26 extending perpendicularly to the cylindrical wall 25 are coupled to each other by a beveled surface 27 for installing an O-ring therein.

The bottom wall 22 has an axial surface 29 on its radially inner edge, the axial surface 29 extending axially inwardly of the interstage casing. A liner ring 28 is attached to the axial surface 29. An impeller 30 is mounted on the shaft 31 and has an inlet end spaced from the liner ring 28 by a small gap or clearance.

A return blade 32 is welded or otherwise securely joined to the outer surface of the bottom wall 22. A side plate 33 is attached to a lateral end of the return blade 32.

The next interstage casing has a bottom wall 22*a* that fits as the male member of a spigot joint, in the cylindrical wall 25. A return blade 32*a* and a side plate 33*a* attached thereto are housed in the interstage casing structure A. The impeller 30 has a passage 34 for the liquid to flow therethrough from its inlet. The shaft 31 extends through a central hole 35 defined in the return blade 32.

During operation of the pump, the liquid discharged out of the impeller in the preceding interstage casing is directed radially inwardly by the return blade 32, and introduced into the passage 34 from the inlet of the impeller 30 housed in the interstage casing body A. After the pressure of the liquid is increased by the impeller 30, the liquid is directed to the return blade 32*a* of the next interstage casing, in which the pressure of the liquid is restored while the liquid is being directed radially inwardly.

With the interstage casings put together, the cylindrical wall 25*a* of the preceding interstage casing is fitted over the cylindrical wall 23, and the cylindrical flange 26*a* joined to the cylindrical wall 25*a* is held against the radial end wall 24 that extends perpendicularly to the cylindrical wall 23. The cylindrical walls 25*a*, 23, the cylindrical flange 26*a*, and the radial end wall 24 are held together by casing bolts (not shown). Since the cylindrical walls 25*a*, 23, the cylindrical flange 26*a*, and the radial end wall 24 are fabricated by molds with their dimensional accuracy achieved by the dimensional accuracy of the molds themselves, it is not necessary to machine these walls and the flange after they are formed.

The beveled surface 27 extending between the cylindrical wall 25 and the flange 26, and the cylindrical wall 23 and radial end wall 24 of the adjacent interstage casing jointly define a space 27*b* of substantially triangular cross section for installing an O-ring therein. Since O-rings, which are most generally used as interstage seals in multistage centrifugal pumps, can be employed in interstage casings, the interstage casing according to the present invention can be used in high-pressure pumps.

Figure 2:
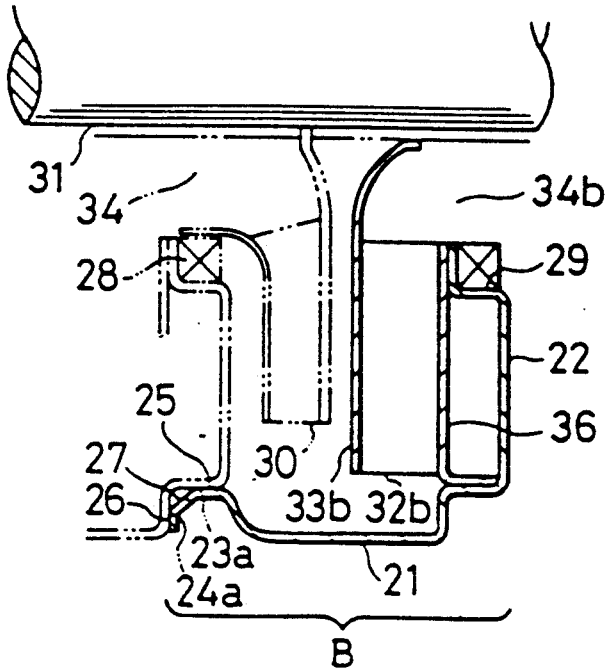
FIG. 2 is a fragmentary cross-sectional view of one half of an interstage casing according to another embodiment of the present invention.

FIG. 2 shows in fragmentary cross section one half of an interstage casing according to another embodiment of the present invention, with a return blade disposed inside the interstage casing. Those parts shown in FIG.

2 which are identical or similar to those shown in FIG. 1 are denoted by identical or similar reference characters.

The embodiment shown in FIG. 2 is different from the embodiment shown in FIG. 1 in that an interstage casing body B has a bottom wall 22 positioned on a pump discharge side (on the right-hand side of FIG. 2), i.e., adjacent to an interstage casing which houses an impeller for developing a higher head, and a return blade 32*b* is attached to the inner surface of the bottom wall 22 by a side plate 36. The interstage casing body B has a flange 26 held against a radial end surface 24*a* of a preceding interstage casing, a cylindrical wall 25 fitted over a cylindrical wall 23*a* of the preceding interstage casing, and a central cylindrical side wall 21 whose outside diameter is larger than the outside diameters of the cylindrical wall 25 and the flange 26. These features shown in FIG. 2 are the same as the corresponding features shown in FIG. 1.

Figure 3:
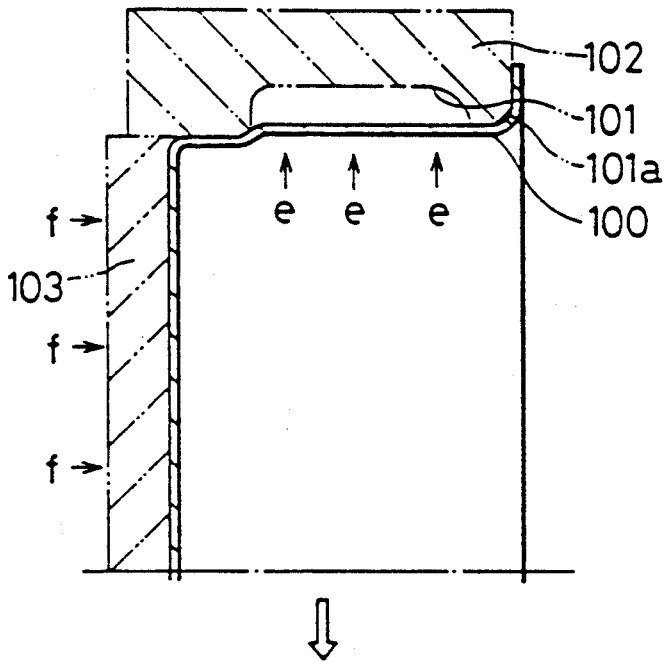
FIG. 3 is a fragmentary cross-sectional view of a blank to be shaped into an interstage casing by bulging.
Figure 4:
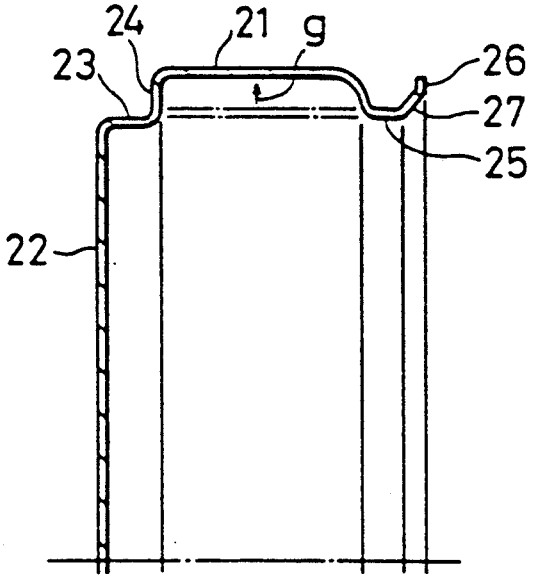
FIG. 4 is a fragmentary cross-sectional view of an interstage casing shaped by bulging.
Figure 5:
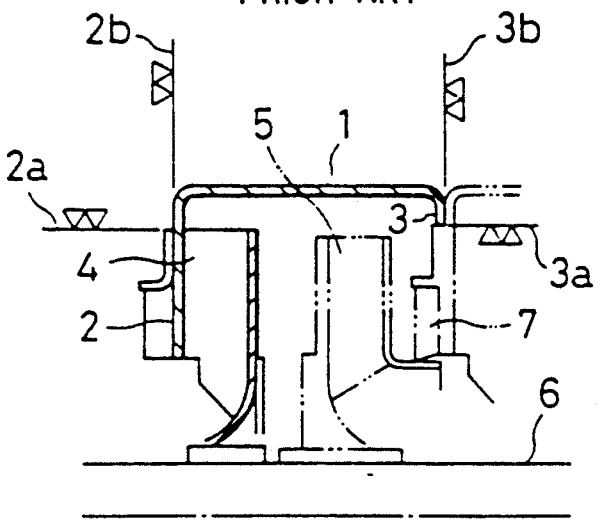
FIG. 5 PRIOR ART
FIG. 5 is a fragmentary cross-sectional view of a generally conventional interstage casing.
Figure 6A:
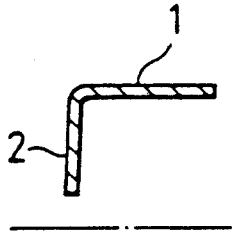
FIG. 6(a) PRIOR ART
FIG. 6(*a*) and 6(*b*) are fragmentary cross-sectional views showing a conventional manner in which a metal sheet is shaped into the interstage casing shown in FIG. 5.
Figure 6B:
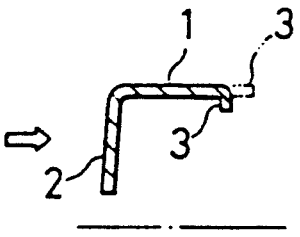
FIG. 6(b) PRIOR ART
Figure 7:
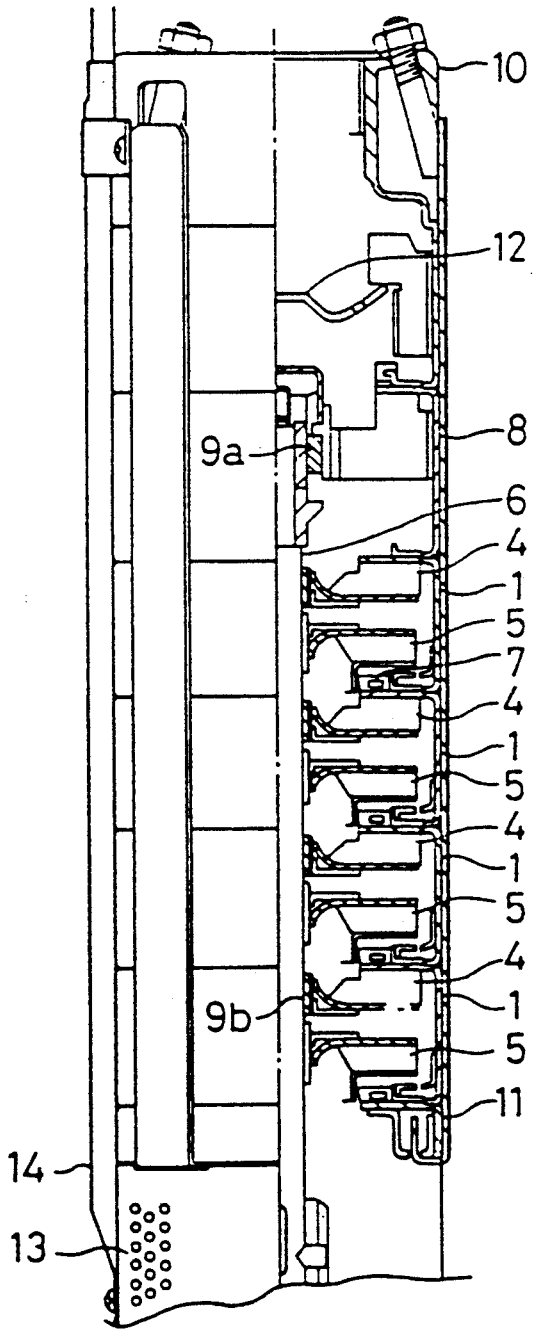
F I G. 7 PRIOR ART
FIG. 7 is a longitudinal cross-sectional view of a multistage centrifugal pump with conventional interstage casings.

FIG. 3 shows in cross section a blank to be formed into an interstage casing body by bulging, which is one of the press forming processes, the blank being mounted in outer molds 102, 103. FIG. 4 shows in cross section a completed interstage casing body.

To form an interstage casing by bulging, a metal sheet is first pressed into a cylindrical receptacle-like body 100 (FIG. 3) by deep drawing, the cylindrical receptacle-like body 100 having a flanged opening in one end and a bottom wall on the other end. The cylindrical receptacle-like body 100 is then set in the outer mold 102, which has a recess 101 corresponding to a central cylindrical side wall that projects radially outwardly, and a beveled surface 101*a* on its inner surface. The outer mold 102 can be divided into two segments. An elastic medium such as oil or rubber is placed in the cylindrical body 100. While the elastic medium is applying an internal pressure radially outwardly to the cylindrical wall of the cylindrical body 100 in the direction indicated by the arrows e, the outer mold 103 is pressed to force the bottom wall toward the opening of the cylindrical body 100 in the direction indicated by the arrow f. In this manner, the blank is pressed or bulged into the interstage casing. More specifically, as shown in FIG. 4, the central cylindrical side wall 21 is deformed in the direction indicated by the arrow g into the recess 101 of the outer mold 102. The interstage casing thus fabricated is of an integral structure. The cylindrical wall 23 that serves as the male member of a spigot joint, and the cylindrical wall 25 that serves as the female member of a spigot joint have a degree of dimensional accuracy depending on the dimensional accuracy of the two-segment outer mold 102. The dimensional accuracy thus achieved corresponds to that which can be accomplished by machining.

The interstage casing has been described as being formed by bulging. However, it may be formed by any of various other press forming processes rather than by bulging. For example, roll forming may be used to enlarge or decrease the diameter of the cylindrical body.

The cylindrical walls, which serve as the male and female members of spigot joints, may be of any shape so long as they can fit together with each other.

The interstage casing according to the present invention offers the following advantages:

Since the interstage casing is not machined, it is not deformed or subjected to dimensional errors by forces that would be applied if the sheet metal were fastened for machining, or by stresses and heat that would be developed if the sheet metal were machined. The desired dimensional accuracy of certain regions of the interstage can be achieved by the dimensional accuracy of the mold used.

The total of steps required to fabricate the interstage casing is reduced because the machining process, which is entirely different from the press forming process, is eliminated.

Inasmuch as the regions of the conventional interstage casing which are subject to greatest loads are machined, the other regions tend to have a larger thickness so that those regions under the greatest loads have the thickness necessary to withstand such loads. According to the present invention, however, the interstage casing may be uniform in thickness, have a relatively low weight, and be reduced in cost.

The beveled surface lying between the cylindical wall and the flange allows an O-ring to be used as a seal between adjacent interstage casings. Therefore, the interstage casing, which is formed of pressed sheet steel, can be used in environments that should be free from liquid leakage and in high-pressure pumps that develop relatively high pressures.

The central cylindrical side wall of the interstage casing is formed by bulging radially outwardly the drawn blank whose diameter corresponds to the diameter of the cylindrical walls, or the male and female members, of the spigot joints. Accordingly, the various regions of the interstage casing may be of uniform thickness. The bulging process for forming the interstage casing according to the present invention requires an internal pressure ranging from several hundred $kg/cm^2$ to several thousand $kg/cm^2$ to be applied to the sheet metal blank. Under such an internal pressure applied, the sheet steel blank is forced into intimate contact with the outer mold. The dimensional accuracy of the interstage casing formed by bulging is higher than if it were formed by other press forming processes. Inasmuch as the final shape of the interstage casing can be achieved in one operation by bulging, the interstage casing can be fabricated in a shorter period of time and with fewer steps than if it were fabricated by other press forming processes.

Although certain preferred embodiments of the present invention have been shown and described in detail, it should be understood that various changes and modifications may be made therein without departing from the scope of the appended claims.

What is claimed is:

1. An interstage casing for a pump having a central rotational axis, said casing comprising:

a casing end wall adapted to extend perpendicular to the central rotational axis;

a first cylindrical wall joined, at a first end thereof, to said casing end wall and extending perpendicularly away therefrom in a first direction, said first cylindrical wall constituting a male member for a spigot joint;

a central cylindrical side wall integrally joined, at a first end thereof, to a second end of said first cylindrical wall and extending away from said first cylindrical wall in said first direction, said central cylindrical side wall being perpendicular to said casing end wall;

a second cylindrical wall integrally joined, at a first end thereof, to a second end of said central cylindrical side wall and extending away from said central cylindrical side wall in said first direction, a second end of said second cylindrical wall defining a periphery of an opening such that said second cylindrical wall constitutes a female member for a spigot joint;

a flange integrally extending radially outwardly from said second end of said second cylindrical wall;

wherein said central cylindrical side wall has an outside diameter larger than outside diameters of said first cylindrical wall, said second cylindrical wall, and said flange; and wherein said casing end wall, said first cylindrical wall, said central cylindrical side wall, said second cylindrical wall and said flange are formed of sheet metal.

2. An interstage casing as recited in claim 1, wherein said casing end wall, said first cylindrical wall, said central cylindrical side wall, said second cylindrical wall and said flange together form an integral unitary sheet metal unit.

3. An interstage casing as recited in claim 1, further comprising a beveled surface between said second cylindrical wall and said flange, said beveled surface providing a space for installing an O-ring therein.

4. An interstage casing as recited in claim 1, further comprising a radial end wall integrally joined to and extending between said central cylindrical side wall and said first cylindrical wall so that a flange of another casing can be held against said radial end wall.

5. An interstage casing as recited in claim 4, wherein said radial end wall is integrally joined directly to both said first cylindrical wall and said central cylindrical side wall, and said first cylindrical wall is integrally joined directly to said casing end wall.

6. An interstage casing as recited in claim 1, wherein said casing end wall has an axial surface on its radially inner edge, said axial surface extends axially inwardly of the interstage casing and serves as a supporting member for supporting a liner ring.

7. An interstage casing as recited in claim 1, wherein said central cylindrical side wall is fabricated by bulging radially outwardly a drawn blank having a diameter corresponding to the diameter of the male and female members of the spigot joints.

8. A multistage centrifugal pump comprising:

a rotatable shaft;

a plurality of impellers supported on said shaft; and a plurality of series-connected interstage casings for enclosing said impellers, respectively, each of said interstage casings comprising:

a casing end wall adapted to extend perpendicular to the central rotational axis;

a first cylindrical wall joined, at a first end thereof, to said casing end wall and extending perpendicularly away therefrom in a first direction, said first cylindrical wall constituting a male member for a spigot joint;

a central cylindrical side wall integrally joined, at a first end thereof, to a second end of said first cylindrical wall and extending away from said first cylindrical wall in said first direction, said central cylindrical side wall being perpendicular to said casing end wall;

a second cylindrical wall integrally joined, at a first end thereof, to a second end of said central cylindrical side wall and extending away from said central cylindrical side wall in said first direction, a second end of said second cylindrical wall defining a periphery of an opening such that said second cylindrical wall constitutes a female member for a spigot joint;

a flange integrally extending radially outwardly from said second end of said second cylindrical wall;

wherein said central cylindrical side wall has an outside diameter larger than outside diameters of said first cylindrical wall, said second cylindrical wall, and said flange; and wherein said casing end wall, said first cylindrical wall, said central cylindrical side wall, said second cylindrical wall and said flange are formed of sheet metal.

9. A multistage centrifugal pump as recited in claim 8, wherein for each of said interstage casings, said casing end wall, said first cylindrical wall, said central cylindrical side wall, said second cylindrical wall and said flange together form an integral unitary sheet metal unit.

10. A multistage centrifugal pump as recited in claim 8, further comprising for each of said casings, a radial end wall integrally joined to and extending between said central cylindrical side wall and said first cylindrical wall so that a flange of another casing can be held against said radial end wall.

11. A multistage centrifugal pump as recited in claim 10, wherein for each of said casings, said radial end wall is integrally joined directly to both said first cylindrical wall and said central cylindrical side wall, and said first cylindrical wall is integrally joined directly to said casing end wall.

* * * * *